United States Patent [19]

Miles

[11] Patent Number: 4,790,470

[45] Date of Patent: Dec. 13, 1988

[54] FASTENER INSTALLATION APPARATUS

[75] Inventor: Michael Miles, Stevenage, England

[73] Assignee: Avdel Limited, Hertfordshire, England

[21] Appl. No.: 35,188

[22] Filed: Apr. 7, 1987

[30] Foreign Application Priority Data

Apr. 11, 1986 [GB] United Kingdom ..... 8608817

[51] Int. Cl.[4] ..... B21J 15/28

[52] U.S. Cl. ..... 227/1; 227/2

[58] Field of Search ..... 72/10, 12, 391, 453, 72/17; 227/1, 2, 53, 55; 29/DIG. 78

[56] References Cited

U.S. PATENT DOCUMENTS 3,685,716 8/1972 Frankie et al. ..... 227/1

FOREIGN PATENT DOCUMENTS 2130949 6/1984 United Kingdom ..... 72/391

*Primary Examiner*—Frank T. Yost
*Assistant Examiner*—James L. Wolfe
*Attorney, Agent, or Firm*—Oblon, Fisher, Spivak, McClelland & Maier

[57] ABSTRACT

Fastener installation apparatus for operating cylically so as to instal successively a plurality of fasteners of the type in which a portion is broken off at installation (e.g. breakstem blind rivets) comprises a fastener installation head (11) and a pipe (31) for conveying the broken-off portions away from the head to a receptacle (15). Detection device (48) is mounted adjacent the pipe (31) to detect the presence of a broken-off fastener portion at a pre-determined position (58) there along near the receptacle (15). When a portion is thus sensed, an electrical signal is sent by the detection device (48), via a relay (51), to the installation control system (14*a*, 14*b*), so as to allow cyclical operation of the system to continue.

6 Claims, 3 Drawing Sheets

FASTENER INSTALLATION APPARATUS

BACKGROUND OF THE INVENTION

The invention relates to fastener installation apparatus. More particularly it relates to such apparatus for installing fasteners which have a portion which is broken off at installation and has to be removed.

Whereas in the past such fastener installation apparatus (e.g. for installing breakstem rivets) has normally been hand-held by an operator who actuated it and inserted new fasteners one at a time into the apparatus, there is now a requirement for such apparatus to operate cyclically and without direct supervision by an operator, so as to install a plurality of fasteners successively and automatically. Such apparatus is usually arranged to feed new fasteners successively to the fastener installation head, and to remove broken-off portions of fasteners therefrom. In order to enable the apparatus to work automatically without jamming, because of e.g. the misfeed of a new fastener to the installation head, or a broken-off portion not being completely and properly removed therefrom, it is necessary that the correct operation of various parts of the apparatus is monitored and checked automatically.

SUMMARY OF THE INVENTION

The present invention seeks to facilitate such functions.

Accordingly, the present invention provides fastener installation apparatus for installing a fastener with a portion which is broken off at installation, which apparatus comprises:- fastener installation means for installing a fastener and thereby producing a broken-off portion; conveying means for conveying the broken-off portion away from the installation means; and portion detection means for detecting when the broken-off portion has reached a predetermined position on its journey along the conveying means.

Preferably the aforesaid predetermined position is one at which the broken-off portion has completed or substantially completed its journey along the conveying means. Preferably the conveying means discharges the broken-off portion into a receptacle, and the aforesaid predetermined position is adjacent the receptacle. Preferably the conveying means comprises a pipe or hose. Preferably the aforesaid portion detection means comprises a proximity sensor positioned adjacent the pipe or hose.

Where the apparatus is arranged to operated cyclically so as to install a plurality of fasteners successively, preferably it includes control means operative to allow the cyclical operation of the apparatus to continue to install a further fastener only upon the portion detection means detecting the presence at the aforesaid pre-determined position of the broken-off portion of the previously installed fastener.

BRIEF DESCRIPTION OF THE DRAWINGS

A specific embodiment of the invention will now be described by way of example and with reference to the accompanying drawings, in which.

DETAILED DESCRIPTION OF THE PREFERRED EMBODIMENTS

Figure 1:
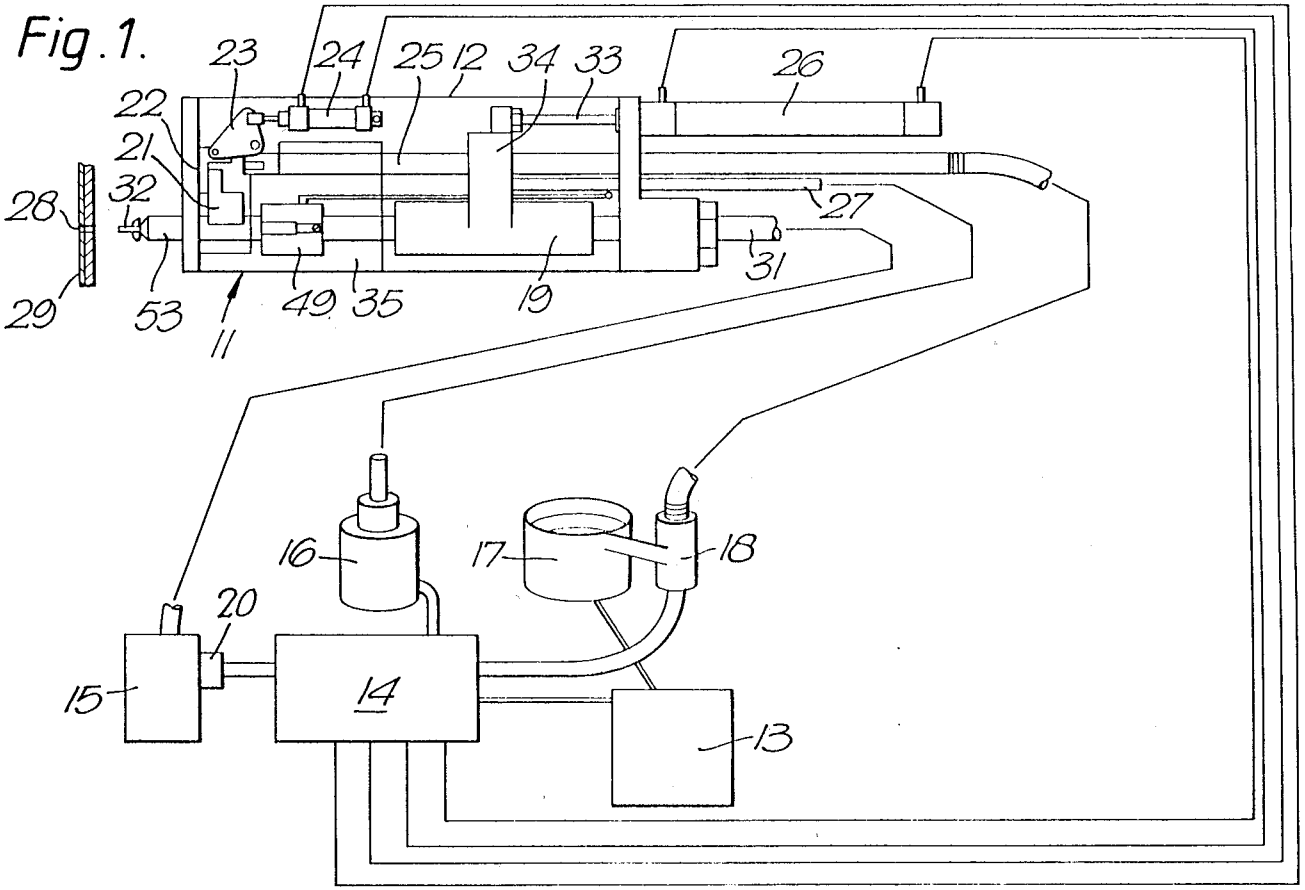
FIG. 1 shows schematically an automatic blind-rivet installation system before the application to it of the present invention.
Figure 4:
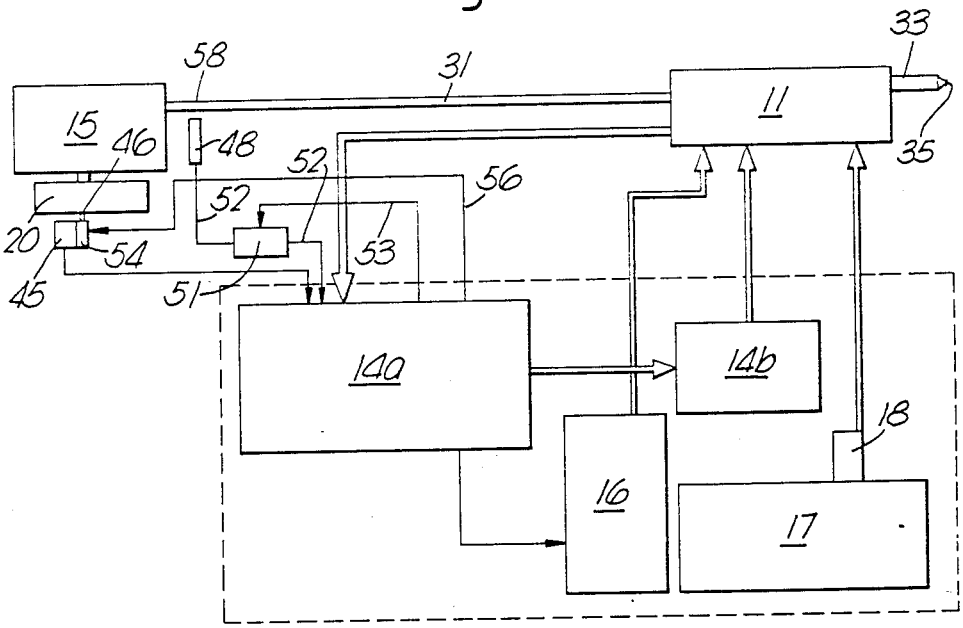
FIG. 4 is a schematic block diagram of the system incorporating the present invention.

Referring first to FIG. 1, a system for automatically and repetitively installing blind breakstem rivets comprises installation apparatus 11 which is built within a rigid frame 12. The system is powered and operated by pneumatic and pneumatic/hydraulic means. To this end it comprises a pneumatic pressure source 13, electronic/pneumatic sequence controller 14, vacuum generator 20 and rivet stem receptacle 15, pneumatic/hydraulic intensifier 16 to power the hydraulically operated rivet installation head, rivet bowl feeder 17 and single rivet feeder 18. The units 11, 16 and 18 and 20 are connected to and controlled by the sequence controller 14 so as to feed new rivets one at a time to the installation apparatus 11 and to control its operation in the way which will be described later. The controller 14 comprises a programmable electronic logic unit **14*a* and a pneumatic valve unit 14*b***. (FIG. 4).

The installation apparatus 11 includes a reciprocable rivet installation head 19. New rivets are fed in front of it, one at a time, when it is in its rearward position, by means of rivet feeding means comprising rivet supporting means 21 which is movable transversely on a slide 22 actuated through bell-crank 23 by a double-acting pneumatic actuator 24, controlled by the sequencer 14. New rivets from the single feeder 18 are blown one at a time into a feed tube 25, from the front end of which the rivet supporting means 21 transfers one rivet at a time to a pick-up position in front of the installation head 19. The installation head 19 is reciprocated axially by a double-acting pneumatic actuator 26, controlled by sequencer 14. The head includes within it a hydraulic actuator, fed by hydraulic pipe 27 from the intensifier 16 which is controlled by the sequencer 14. When the head actuator is operated, it causes jaws 38 (FIG. 2) within the head to grip the rivet stem 36 and pull it, thus deforming the rivet body. After each rivet 32 has been installed in a hole such as 28 in a workpiece 29, the part of the stem which has been gripped and pulled by the jaws 38 is broken off from the remainder of the rivet, and is then released by the jaws, from where it travels rearwardly down a stem extractor pipe 31, into the stem receptacle 15, due to the suction created by the vacuum generator 20.

Figure 2:
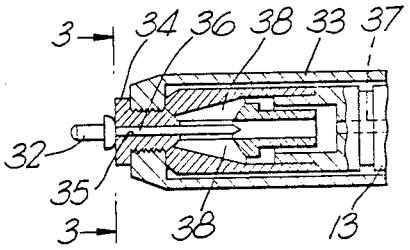
FIG. 2 is an axial section through the front end of the installation head.
Figure 3:
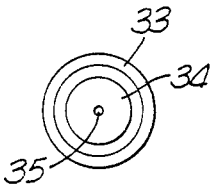
FIG. 3 is an end elevation of the front end of the head, on the line 3—3 of FIG. 2.

The front part of the rivet installation head is shown in FIGS. 2 and 3 and comprises a cylindrical barrel 33 having at its front end an annular steel anvil 34 formed with a central aperture 35. Into this aperture 35 is inserted the stem 36 of each rivet 32. The stem 36 is a fairly close fit in the aperture 35, and the vacuum applied to the aperture 35, through the stem receptacle 15, stem extractor pipe 31 and the axial passage 37 through the head, assists in retaining the rivet on the anvil until it is installed. After each rivet has been installed a further rivet is fed to the head by the rivet feeding means.

The use of an electronic/pneumatic sequencer such as 14 for automatically controlling the various elements of the system is well understood and will not be described further. In the following description it will be assumed that the operation of various elements of the system, and the various elements of the installation apparatus 11 in particular, are operated at the appropriate times by the sequencer 14.

The installation system is intended to operate cyclically, to install rivets successively. Each cycle may be initiated by a suitable signal fed to the sequence controller 14.

As previously explained, it is necessary for the safe and proper operation of the system that operation is allowed to continue to the next stage only if the previous stage is complete. If it is not, operation of the system should stop immediately. Similarly, the rivet installation apparatus should be allowed to proceed to install a further rivet only upon completion of the installation of the previous rivet. Since, when the installation of each rivet is complete, the stem breaks off and is conveyed away from the head 19, along the pipe 31 towards and into the receptacle 15, detection of the presence of a broken off stem at a position along the pipe will indicate that the rivet has been installed.

Figure 5:
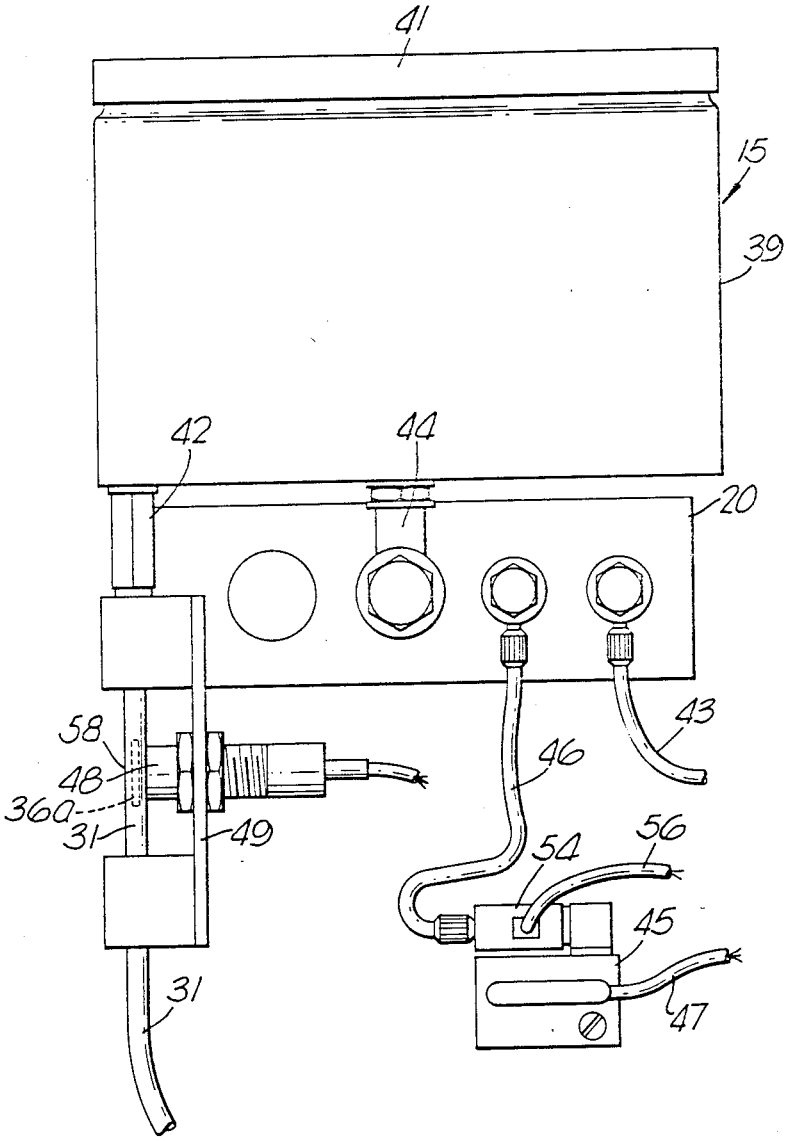
FIG. 5 is a plan view of part of the system.

The means for detecting such stem presence will now be described with reference to FIGS. 4 and 5.

The stem receptacle 15 comprises a metal box 39 with a removable side wall 41 for emptying stems out of the box. The side wall 41 seals the box against air entry. The stem extractor pipe 31 (which consists of a flexible synthetic plastics hose) enters the opposite side of the box through a coupling sleeve 42.

The vacuum generator 20 is of the venturi type which is fed with compressed air through a supply pipe 43. The vacuum side of the generator is connected into the receptacle 15 through a rigid connection 44. The vacuum generator runs continuously and exhausts the receptacle 15 and the stem extractor pipe 31. The other end of the pipe 31 is connected to the passage 37 through the installation head 19, and thus to the aperture 35.

Detection of the progress of a broken off stem along the extraction pipe 31, to a predetermined position 58 which is near the receptacle 15, is achieved by means of a proximity sensor 48. In this example apparatus, the sensor is an inductive sensor, which senses the presence of a metal stem by a change in the electromagnetic inductance. The sensor 48 is mounted immediately against the pipe 31 at the position 8 which is near the receptacle 15. The sensor is held in a bracket 49, through which the pipe 31 also passes, to position the sensor against the pipe. The bracket 49 is mounted on the pipe connector 42. The presence of a broken off stem **36*a* at the position 58 opposite the sensor 48, as the stem passes along the pipe, causes the sensor to emit an electrical output. Since the stem is moving along the pipe at high speed, it actuates the sensor for only a very short time. An electrical output of such short duration is insufficient to actuate the electronic/pneumatic sequence controller 14, so there is provided a solid-state latching relay 51 (FIG. 4) between the proximity sensor 48 and the controller 14. When the sensor 48 detects the passage of a stem and gives an electrical output, this output latches the solid state relay 51 to give an electrical output continuously to the controller 14 until the relay is later reset by a reset pulse applied to it, at an appropriate time, by the controller. The reset pulse is applied along a connection indicated by 53 in FIG. 4**.

The electrical output to controller 14, indicating that the broken-off rivet stem has travelled along the pipe 31 as far as the sensor 48, is arranged to actuate the controller to allow the rivet installation system to continue with a further cycle of installing a further rivet, maybe upon a suitable initiation signal being fed to the controller.

The invention is not restricted to the details of the foregoing example.

Attention is drawn to our co-pending application No. 07/035,189 which includes the foregoing description but claims a different invention.

I claim:

1. Fastener installation apparatus for installing a fastener with a portion which is broken off at installation, which apparatus comprises:

fastener installation means for installing a fastener and thereby producing a broken-off portion;

conveying means for conveying the broken-off portion away from the installation means; and portion detection means operatively connected to the conveying means at a predetermined position therealong for detecting when the broken-off portion has reached said predetermined position on its journey along the conveying means.

2. Apparatus as claimed in claim 1, in which the aforesaid predetermined position is one at which the broken-off portion has completed or substantially completed its journey along the conveying means.

3. Apparatus as claimed in claim 2, including a receptacle into which the conveying means discharges the broken-off portion, and the aforesaid predetermined position is adjacent the receptacle.

4. Apparatus as claimed in claim 1, in which the conveying means comprises a pipe or hose.

5. Apparatus as claimed in claim 4, in which the aforesaid portion detection means comprises a proximity sensor positioned adjacent the pipe or hose.

6. Apparatus as claimed in claim 1, arranged to operate cyclically so as to install a plurality of fasteners successively, which apparatus includes control means responsive to the portion detection means and operative to allow the cyclical operation of the apparatus to continue to install a further fastener only upon the portion detection means detecting the presence at the aforesaid pre-determined position of the broken-off portion of the previously installed fastener.

* * * * *